US006574849B1

(12) United States Patent
Böhm

(10) Patent No.: US 6,574,849 B1
(45) Date of Patent: Jun. 10, 2003

(54) METHOD FOR DEFORMING THROUGH HIGH INNER PRESSURE AT LEAST TWO HOLLOW BODIES HAVING EACH AT LEAST ONE OPENING, ESPECIALLY METAL TUBES OR METAL HOLLOW PROFILES

(75) Inventor: Alfons Böhm, Tönisvorst (DE)

(73) Assignee: Siempelkamp Pressen Systeme GmbH & Co., Krefeld (DE)

( * ) Notice: Subject to any disclaimer, the term of this patent is extended or adjusted under 35 U.S.C. 154(b) by 0 days.

(21) Appl. No.: 09/762,987

(22) PCT Filed: Aug. 4, 1999

(86) PCT No.: PCT/DE99/02431

§ 371 (c)(1),
(2), (4) Date: Feb. 15, 2001

(87) PCT Pub. No.: WO00/10746

PCT Pub. Date: Mar. 2, 2000

(30) Foreign Application Priority Data

Aug. 17, 1998 (DE) ..... 198 37 131
Aug. 17, 1998 (DE) ..... 198 37 130

(51) Int. Cl.[7] ..... B23P 11/02

(52) U.S. Cl. ..... 29/421.1; 29/897.2; 29/445; 29/505; 29/890.148

(58) Field of Search ..... 29/421.1, 505, 29/890.043, 890.044, 890.144, 890.148, 897.2, 897, 428, 445, 469.5, 525.13, 525.14; 72/55, 61, 62; 285/382, 382.1, 382.2, 382.4, 382.5; 403/274, 279, 282, 283, 285

(56) References Cited

U.S. PATENT DOCUMENTS

| | | | | |
|---|---|---|---|---|
| 3,776,523 A | * | 12/1973 | Weiland | 403/274 |
| 4,597,687 A | * | 7/1986 | Colas | 403/274 |
| 4,675,965 A | * | 6/1987 | Offringa et al. | 29/890.148 |
| 5,445,001 A | | 8/1995 | Snavely | |
| 5,937,501 A | * | 8/1999 | Imgram | 285/382.4 |
| 5,996,455 A | * | 12/1999 | Haag et al. | 72/55 |
| 6,305,201 B1 | * | 10/2001 | Ghiran et al. | 72/55 |

FOREIGN PATENT DOCUMENTS

| | | |
|---|---|---|
| DE | 43 20 237 C1 | 8/1994 |
| DE | 196 18 626 A1 | 11/1997 |
| DE | 196 47 962 C1 | 4/1998 |
| DE | 197 30 481 C1 | 7/1998 |
| EP | 0 593 950 A1 | 4/1994 |

* cited by examiner

*Primary Examiner*—Gregory Vidovich
*Assistant Examiner*—T. Nguyen
(74) *Attorney, Agent, or Firm*—Herbert Dubno; Andrew Wilford

(57) ABSTRACT

First and second hollow bodies each having at least one opening are joined by first forming a fracture zone in a joint region of the first body and then juxtaposing the bodies in a closed cavity of an internal high-pressure shaping tool with the second body spaced from and open toward the fracture zone of the first body. The first body is then internally pressurized with a hydraulic medium until a burst pressure at the fracture zone is exceeded and the first body ruptures and is deformed outward at the fracture zone into engagement with the second body. The medium then flows through the ruptured fracture zone into the second body.

14 Claims, 6 Drawing Sheets

Fig. 2a
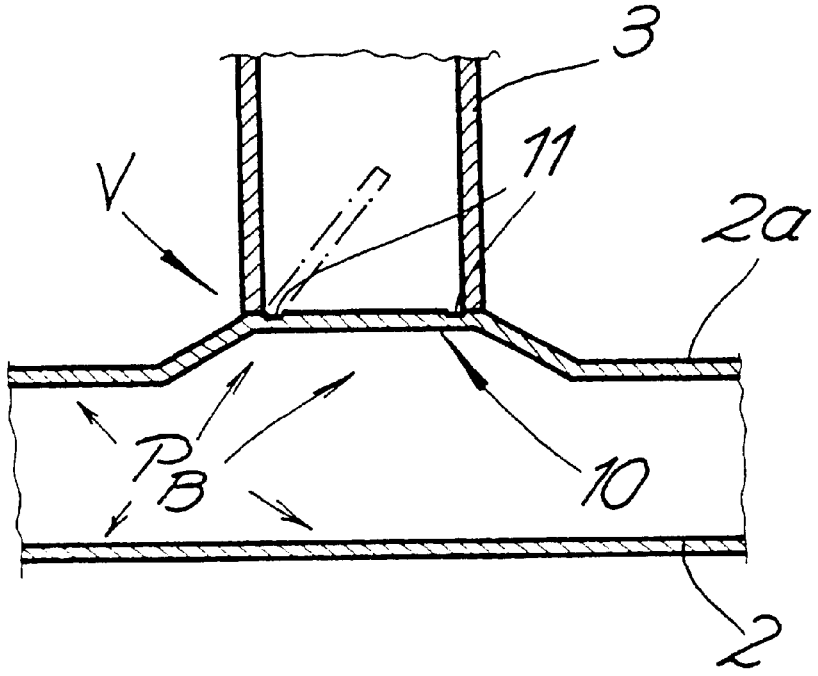
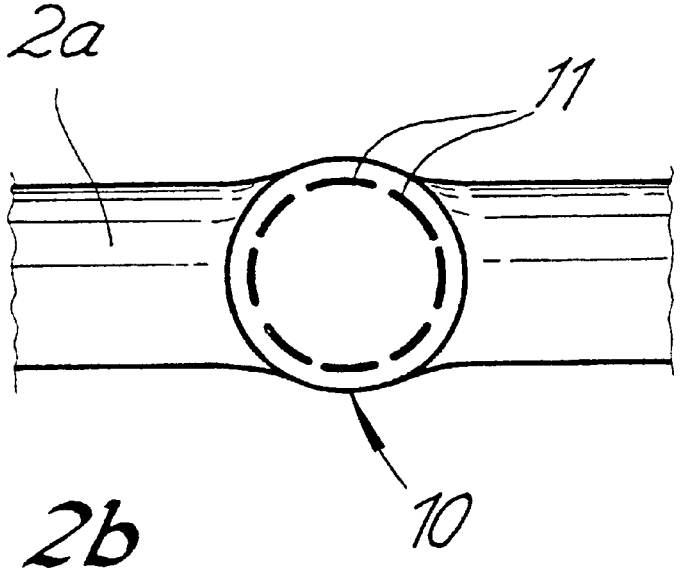
Fig. 2b

Fig.5a
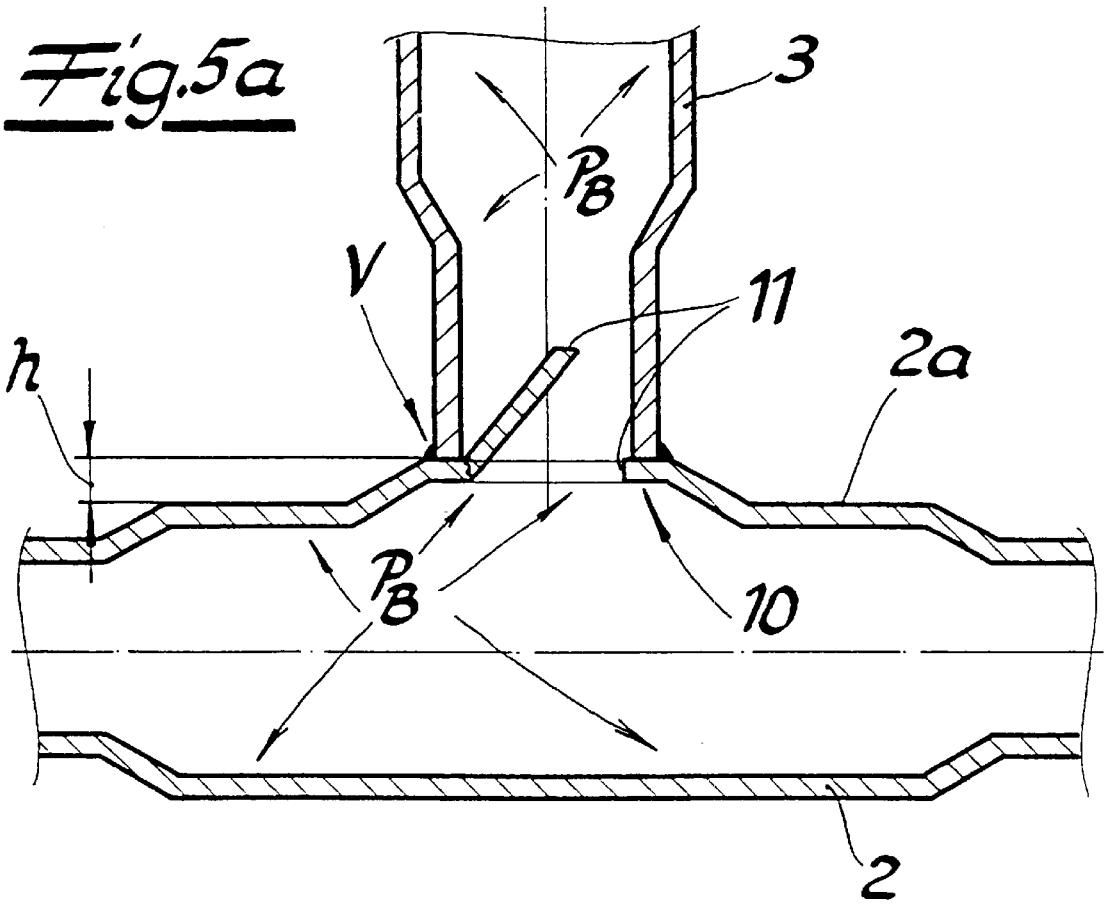
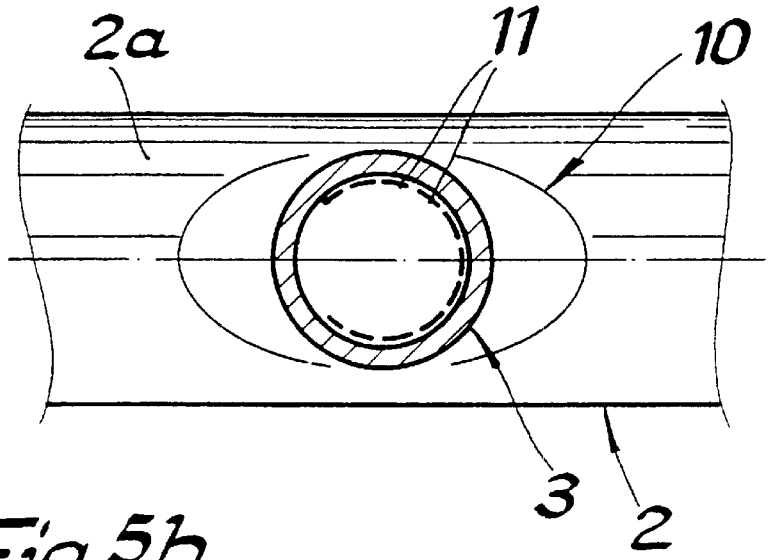
Fig.5b

Fig. 6
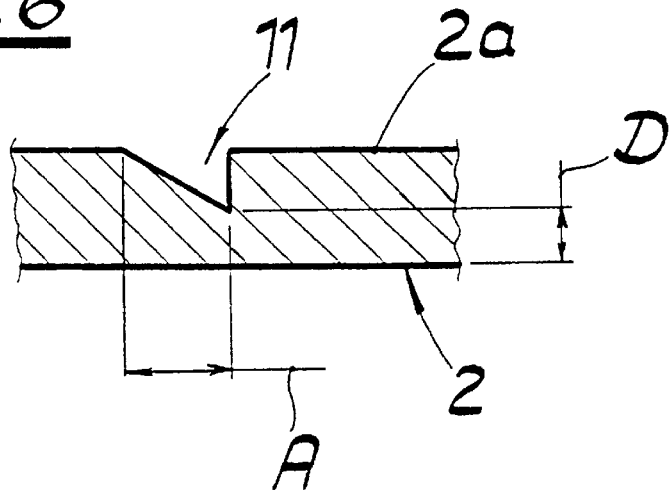
Fig. 7a
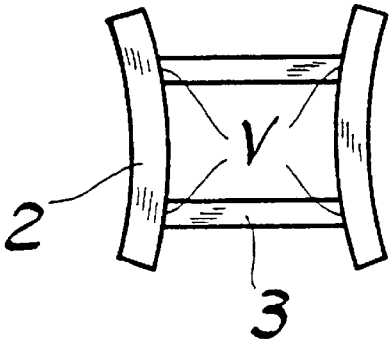
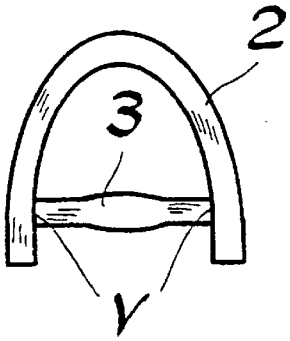
Fig. 7b
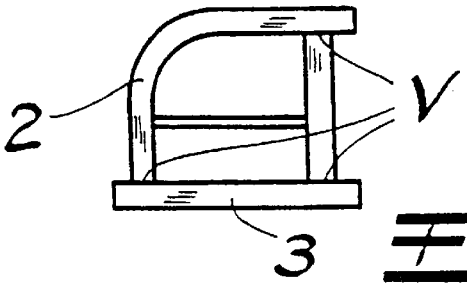
Fig. 7c

METHOD FOR DEFORMING THROUGH HIGH INNER PRESSURE AT LEAST TWO HOLLOW BODIES HAVING EACH AT LEAST ONE OPENING, ESPECIALLY METAL TUBES OR METAL HOLLOW PROFILES

CROSS REFERENCE TO RELATED APPLICATIONS

This application is the US national phase of PCT application PCT/DE99/02431 filed Aug. 4, 1999 with a claim to the priorities of German patent applications 19837130.6 and 19837131.4 both filed Aug. 17, 1998.

FIELD OF THE INVENTION

The invention relates to a method of deforming by high internal pressure at least two hollow bodies each having at least one opening, especially metal tubes or hollow profiles, the hollow body if necessary being produced during an internal high-pressure deformation process.

BACKGROUND OF THE INVENTION

The hollow bodies in question are normally metal tubes, preferably of steel, aluminum, or the like. These metal tubes can be of circular or noncircular as well for example as of rectangular section. Similarly hollow bodies or blanks are used that are put together from several metal parts. In any case it is necessary that the hollow bodies be open at least at one end as is standard with internal high-pressure deformation processes. It is understood that such an internal high-pressure deformation tool can be made of several parts and can be opened so the finished shaped part can be taken out of it.

Internal high-pressure processes are well known (see German patent 4,320,237). Typically they are used when hollow bodies or metal tubes of complicated shape are needed. To this end a tube is deformed which subsequently is shaped by conventional means. This includes inter alia welding-together shaped metal tubes.

In the prior art the standard method is that the individual hollow body is shaped by the internal high-pressure deformation process according to a predetermined design to have a predetermined shape. Such a hollow body is then connected to another hollow body for example by welding. This second hollow body can also be an internal high-pressure deformed hollow body. Classic parts that are made in this manner are complex frame parts as used for example in motor-vehicle frames and/or as chassis parts.

The normally used connection system often creates distortion of the metal tubes being joined or welded together at the connection region. It is also not impossible that the tube walls are weakened in the critical connection region by the welding procedure which is particularly to be avoided in highly loaded tube joints. This applies also to the case when the above-mentioned tubes must be fastened together to be pressure tight as well as in the exemplary complicated torsion-resisting frame parts as for example needed in a motor-vehicle frame or chassis.

In any case the prior art requires a plurality of steps in order to be able to make such complicated tube or frame constructions. In addition the quality could be improved.

OBJECT OF THE INVENTION.

It is therefore the object of the invention to improve on a method of the above-described type such that it allows complicated frame constructions to be made simply and quickly and in addition makes possible a perfect mutual connection of the hollow bodies without distortion.

SUMMARY OF THE INVENTION

This object is attained by the invention according to a first alternative in a method of joining two or more hollow bodies each having at least one opening, in particular metal tubes or profiles, by an internal high-pressure deformation process wherein first

- in a joint region between a first hollow body and a second hollow body to be connected thereto at least one intended fracture zone is formed in an outer wall of the first hollow body, and thereafter
- the outer wall of the first hollow body is expanded outwardly in a closed cavity of a internal high-pressure shaping tool by means of a hydraulic medium at least in the joint region of the two bodies to form a flange, while
- the second body to be joined is held in the cavity of the internal high-pressure shaping tool at a predetermined spacing from the flange, and thereafter
- the hydraulic medium flows after exceeding the burst pressure for the intended fracture zone into the second hollow body to optionally shape it by internal high-pressure deformation and to join the first hollow body by its flange with the second hollow body.

A second embodiment of the invention is a method of joining two or more hollow bodies each having at least one opening, in particular metal tubes or profiles, by an internal high-pressure deformation process wherein first

- in a joint region between a first hollow body and a second hollow body to be connected thereto at least one intended fracture zone is formed in an outer wall of the first hollow body, thereafter
- the first hollow body and the second hollow body are engaged together at the joint region, thereafter
- the outer wall of the first hollow body is expanded outwardly in a closed cavity of an internal high-pressure shaping tool by means of a hydraulic medium at least in the joint region of the two bodies, and subsequently
- the hydraulic medium flows after exceeding the burst pressure for the intended fracture zone into the second hollow body to shape it by internal high-pressure deformation.

Joining according to the invention means solidly connecting and preferably material joining between the hollow bodies.

With the method of the first embodiment of the invention the hollow bodies can be so joined that the first hollow body simultaneously engages with its flange into the second hollow body and thus forms a joint in the joint region.

The first embodiment also provides that the outer wall of the first hollow body is expanded outward to form a flange so that the second hollow body to be joined thereto is held at a spacing from the flange. The expansion of the first hollow body takes place as is standard in a closed cavity of an internal high-pressure deforming tool by means of the described hydraulic pressure medium. According to a preferred embodiment the to-be-joined second hollow body is held in this cavity at a spacing from the flange region.

Normally the mechanical weakening of the outer wall or the formation of the intended fracture zone is achieved in that the intended fracture zone is defined by a blind bore, stamping, recessing, spark-eroded boring, metal-etch boring, or the like. Normally instead of one intended fracture zone a plurality of intended fracture zones are formed in the outer wall of the first hollow body aligned with the inner profile of the second hollow body. This zone or zones are formed before fitting the hollow body into the internal high-pressure deforming tool by means of an external boring and/or stamping device or inside the internal high-pressure deforming tool, preferably by an integrated drill, stamp, or the like.

Here material is removed at the intended fracture zone according to the stretch-to-break of the material of the first hollow body with reference to a predetermined burst pressure. This is of course determined in particular by the material of the first hollow body which is expanded during internal high-pressure deformation to form the flange. In any case there are generally two possibilities. On the one hand the intended fracture zone produces a weakening of the outer wall of the first hollow body and the pressure in the hydraulic medium increases until the zone breaks and the medium flows into the second hollow body. On the other hand the pressure medium can be used at the predetermined maximum pressure so that in this case the intended fracture zone or zones are such that on reaching this maximum pressure in any case the burst pressure is exceeded or the maximum pressure is equal to this burst pressure.

This can be done by appropriate removal of material and/or a weakening of the material in the intended fracture zone. As a result there is a metallurgical (grain) weakening. The invention is based on the recognition that, after exceeding the so-called flow or stretch limit (measured in N/mm2), the material used normally for the metal tubes has a shape change caused by the actual tension that can break it. In any case it is in particular true with stretching tension—as is particularly obtained with pressure buildup—to create a split at the intended fracture zone. The pressure of the hydraulic medium necessary for this is determined by the characteristics of the material used and the thickness in the region of the intended fracture zone. As a result the thickness of the outer wall can be set in accordance with the material being used and the predetermined internal pressure of the hydraulic medium or its maximum pressure so that on reaching the desired internal pressure or maximum pressure in any case the intended fracture zone will rupture or at least the burst pressure will be reached and in most cases exceeded.

Thus hollow bodies of widely differing wall thickness can be joined in one and the same internal high-pressure deforming tool. Hence a flexible accommodation to wholly different hollow bodies and different workpieces is possible without problems.

According to the second embodiment both hollow bodies are joined at the joint region before the outer wall of the first hollow body is expanded. When this hollow-body connection is made, first an internal high-pressure deformation of the first hollow body is done, namely in the joint region of both bodies. The hydraulic pressure at this location causes, as a result of the intended fracture region there, the hydraulic medium to exceed the burst pressure for the intended fracture zone and flow into the second hollow body. Since this second hollow body is contained in the cavity of the internal high-pressure deforming tool an internal high-pressure deformation (of the second hollow body) is possible. As a result in a simple and fast manner the two hollow bodies that are to be joined are deformed in one internal high-pressure deforming operation so that even complicated tube or frame constructions can be made in a single step. Of course the invention is not limited to the internal high-pressure deformation of two hollow bodies, but any desired number or hollow bodies can first be connected together and then acted upon by a hydraulic medium in the joint region by burst pressure breaking through the fracture zone. Hence even complicated motor-vehicle frames or constructions can be made in a single method step.

Fitting together of the first and second hollow bodies at the fracture zone and the subsequent joining of the hollow bodies inside or outside the internal high-pressure deforming tool can be done with standard material-joining methods such as welding, soldering, shrinking, gluing, or the like. Thus this joining of the two hollow bodies normally takes place outside the internal high-pressure deforming tool. Of course it is also possible to join the hollow bodies inside the internal high-pressure deforming tool, the two hollow bodies for example being united by pressure or a groove/ridge interfit which is subsequently (additionally) glued, riveted, or the like. This necessitates however complicated means inside the internal high-pressure deforming tool which thus must be for example made separable.

On joining the hollow bodies inside the internal high-pressure deforming tool and the provided flange it is possible to unite this formation and the confronting spaced second hollow body with a groove/ridge connection. In this case also complicated means are necessary inside the internal high-pressure deforming tool which must be made separable in the region of the produced flange. Thus it is conceivable that the flange is first formed with an outside diameter which is smaller than an inside diameter of the second body to be connected to it. After this flange is formed, the internal high-pressure deforming tool is opened at this location and the second hollow body is fitted over the flange. Of course up to this time the burst pressure has not been reached. When now the pressure is raised to the burst pressure, the flange engages from inside on the second hollow body like a shrink fit so that further welding can be eliminated.

Finally one normally loads the basic frame of interconnected hollow bodies as a single assembly (after forming the intended fracture zone or zones by grooving) into the internal high-pressure deforming tool and then starts the internal high-pressure deformation, starting with the first hollow body.

Independently of this the invention makes it possible to deform two or more coaxially interfitted hollow bodies in a single internal high-pressure deforming tool. In the simplest case this is done with a double tube where the inner tube (first hollow body) is expanded to form a flange and subsequently this flange is joined with the inner surface of the outer tube (second hollow body). Of course this can be one with two or more hollow bodies which do not have to be aligned coaxially. It is also possible within the scope of the invention to form a flange on the outer tube (second hollow body) with both flanges being connected together. In any case this procedure makes it possible to deform the outer tube after fracturing of the intended fracture zone by internal high pressure. Generally it is thus clear that internal high-pressure deformed frame assemblies can be made with interfitting hollow bodies.

BRIEF DESCRIPTION OF THE DRAWING

In the following the invention is more closely described with reference to a drawing showing only one embodiment. Therein:

FIGS. 2*a* and 2*b* show a detail of FIG. 1 after exceeding the burst pressure;

FIGS. 5*a* and 5*b* are sections corresponding to FIG. 4*c*, partly after exceeding the burst pressure (see FIG. 5*a*);

FIG. 6 is an enlarged section from FIG. 4*a* in the region of a intended fracture zone; and FIGS. 7*a* through 7*c* are various parts made according to the method of this invention.

SPECIFIC DESCRIPTION

Figure 1:
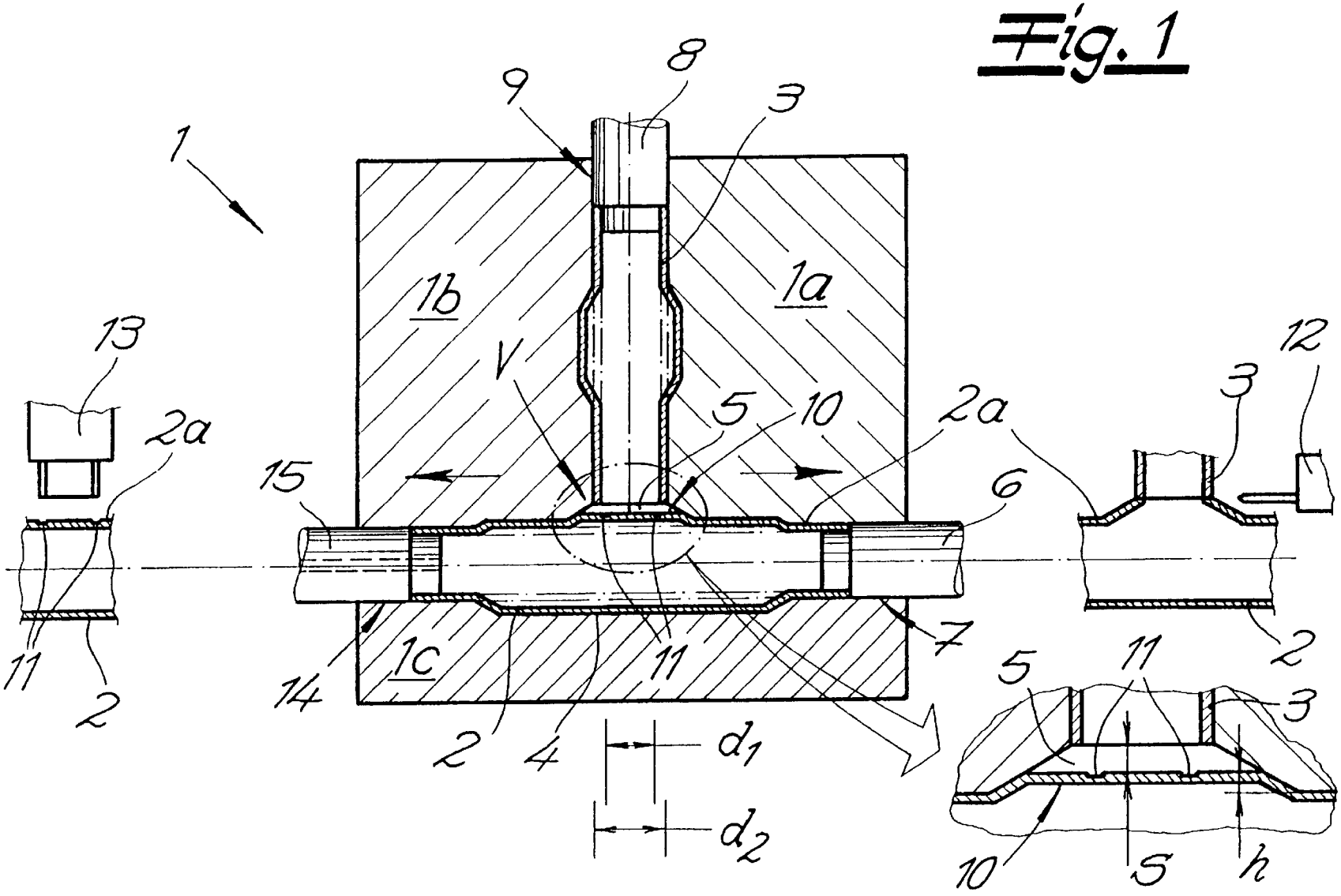
FIG. 1 shows a first embodiment of the internal high-pressure deforming machine according to the invention in an overall view with individual details in enlargement.

The Figures show an internal high-pressure deforming machine which basically is formed of a two part internal high-pressure deforming tool 1 with a cavity 5 having an internal wall 4 corresponding to the final shape of the hollow bodies 2 and 3 to be deformed. Here the internal high-pressure deforming tool 1 has three parts 1*a*, 1*b*, and 1*c*. The hollow bodies 2 and 3 are metal tubes. In addition there is a device 6 for loading the first hollow body 2 as well as a further loading device 8 for feeding in the second hollow body 3. To this end there is a first infeed opening 7 as well as a second infeed opening 9 in the cavity 5 of the internal high-pressure deforming tool 1.

Figure 3:
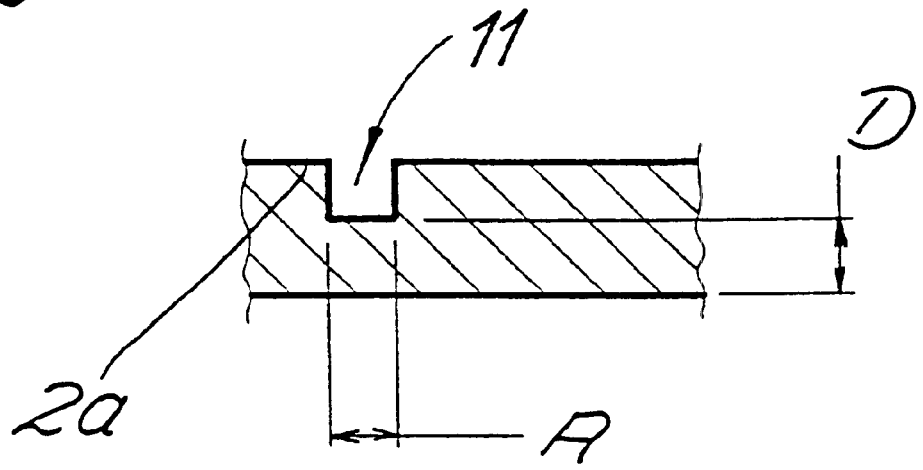
FIG. 3 is an enlarged sectional detail of FIG. 1 in the region of a intended fracture zone.

According to a first embodiment of the invention according to FIGS. 1 through 3 the second hollow body 3 is set in the cavity 5 at a spacing S from the first hollow body 2 which has been formed with a flange 10 and an intended fracture zone 11. The second hollow body 3 is connectable to the first hollow body 2 after exceeding of the burst pressure PB for the intended fracture zone 11 and if necessary any internal high-pressure deformation. This takes place in a connecting device 12. Finally there is a drilling and/or stamping device 13 for forming the intended fracture zone 11. According to the illustrated embodiment there are a plurality of intended fracture zones 11 that are positioned according to the internal shape of an open end of the second hollow body 3 and formed in an outer wall 2*a* of the first hollow body 2. This shape of the intended fracture zone 11 conforming the inner shape of the second hollow body 3 is shown in particular in FIG. 2*b*. The intended fracture zone 11 can be formed such that it creates on exceeding the burst pressure PB a sort of hinge that remains and pivots up as cover into the second hollow body 3. This is shown in FIG. 2*a* in dot-dash lines.

It is also possible to use a drilling and/or stamping device 13 extending through the internal high-pressure deforming tool 1 for forming the intended fracture zone 11 in the first hollow body 2. This is not shown. What is illustrated is rather the provision of a separate material-removing device 13 for forming the intended fracture zone 11 (see FIG. 1). The connection device 12 is in the illustrated embodiment a separate welding device 12. This connection device 12 can also be integrated into the internal high-pressure deforming tool 1, but this is not shown.

The method according to the invention takes place in the illustrated internal high-pressure deforming tool 1 as follows. First several intended fracture zones 11 are formed in the outer wall 2*a* of the first hollow body 2. This is done by a material-removing device 13, normally by stamping the intended fracture zones 11 as shown in FIG. 2*b*. The stamping or the material removal at the intended fracture zones 11 is done in accordance with the stretch-to-break characteristic of the material of the first hollow body 2 in accordance with a predetermined burst pressure PB. This burst pressure PB is illustrated in FIG. 2*a*. The corresponding material removal or the remaining residual thickness D of the inner wall 2*a* of the first hollow body 2 at the intended fracture zone 11 is shown in FIG. 3. Of course the width A of the intended fracture zone 11 must be such that when the burst pressure PB is reached the inner wall 2*a* tears at the intended fracture zone 11. This has been described above.

Then the two hollow bodies 2 and 3 are loaded into the internal high-pressure deforming tool 1. This is done by the device 6 for loading the first hollow body and the device 8 for loading the second body 3. The loading takes place through the respective first and second infeed openings 7 and 9. The respective devices 6 and 8 are formed as pressure-holding pistons 6 and 8. After the hollow bodies 2 and 3 have been pushed by the loading pistons 6 and 8 through the first and second infeed openings 7 and 9 into the cavity 5 the internal high-pressure deformation takes place.

To this end the second hollow body 3 is first held in the cavity 5 at the predetermined spacing S from the part to be widened at the flange 10 of the first hollow body 2. The upward expansion for forming the flange 11 can be determined by the known properties of the material of the material of the first hollow body 2 with respect to the burst pressure PB. Thus the upward movement h of the flange 10 is determined mainly by the characteristics of the material and the burst pressure PB. The radial expansion of the flange 10 longitudinally of the first hollow body 2 is on the other hand determined by the shape of the inner wall 4 of the cavity 5. Finally another loading piston 15 is fitted in another opening 14. Since the devices 6 and 8 are formed as sealing and pushing pistons 6 and 8, sealant for producing the desired high internal pressure can be fed in through the internal high-pressure piston 15 without escaping. As pressure builds up by means of the hydraulic medium the outer wall 2*a* of the first hollow body expands in the closed cavity 5 at least in the joint region V of the two hollow bodies 2 and 3 to form the flange 10. This transition is seen from FIG. 1 to FIG. 2*a*. With respect to this flange formation the second hollow body 3 is spaced in the die cavity 5 at the predetermined spacing S from the flange 10. Of course other or additional shapes (in addition to the flange formation) are possible in the hollow body 2.

After exceeding the burst pressure PB for the intended fracture zone 11 the hydraulic medium flows into the second hollow body 3 which otherwise is not pressurized and in particular has no internal high-pressure piston 15 like the first hollow body 2. The hydraulic medium can flow into the second hollow body 3 without doing any internal high-pressure deformation. Normally one proceeds in that the second hollow body 3 is also shaped by internal high-pressure deformation. To this end of course the loading opening 9 must be completely closed by the sealing piston 8. As a result in a single process two internally high-pressure shaped hollow bodies 2 and 3 are made which can easily be joined together at the formed flange 10.

This joint is made according to the illustrated embodiment in the separate welder 12 outside the internal high-pressure deforming tool 1.

It also within the scope of this invention possible that the internal high-pressure deforming tool 1, which in the illustrated embodiment is formed of three parts 1*a*, 1*b*, and 1*c*, can be separated at the joint region V. Thus the two parts 1*a* and 1*b* can be retracted radially as shown in FIG. 1.

In this manner the flange 10 has a starting diameter d1 which is smaller than an inside diameter d2 of the second hollow body 3. Subsequently the noncontacting hollow body 3 is aligned with this flange 10. Then the pressure is raised to the burst pressure PB so that the flange 10 comes to engage the inner wall of the second hollow body 3. It is also possible in this case to form a joint without additional welding. Of course an interfitting groove and ridge can be formed at this location at the end of the second hollow body 3 and around the flange 10. This is not shown.

In addition it is possible to sequentially load the two hollow bodies 2 and 3 into the cavity of the internal high-pressure deforming tool 1 in the case when the two hollow bodies 2 and 3 are joined together in the cavity. According to the two embodiments this joining takes place outside the internal high-pressure deforming tool 1 by means of the already described external connection device 12 as shown in FIG. 1 and also in FIG. 4*b*.

Figures 4A, 4B, 4C:
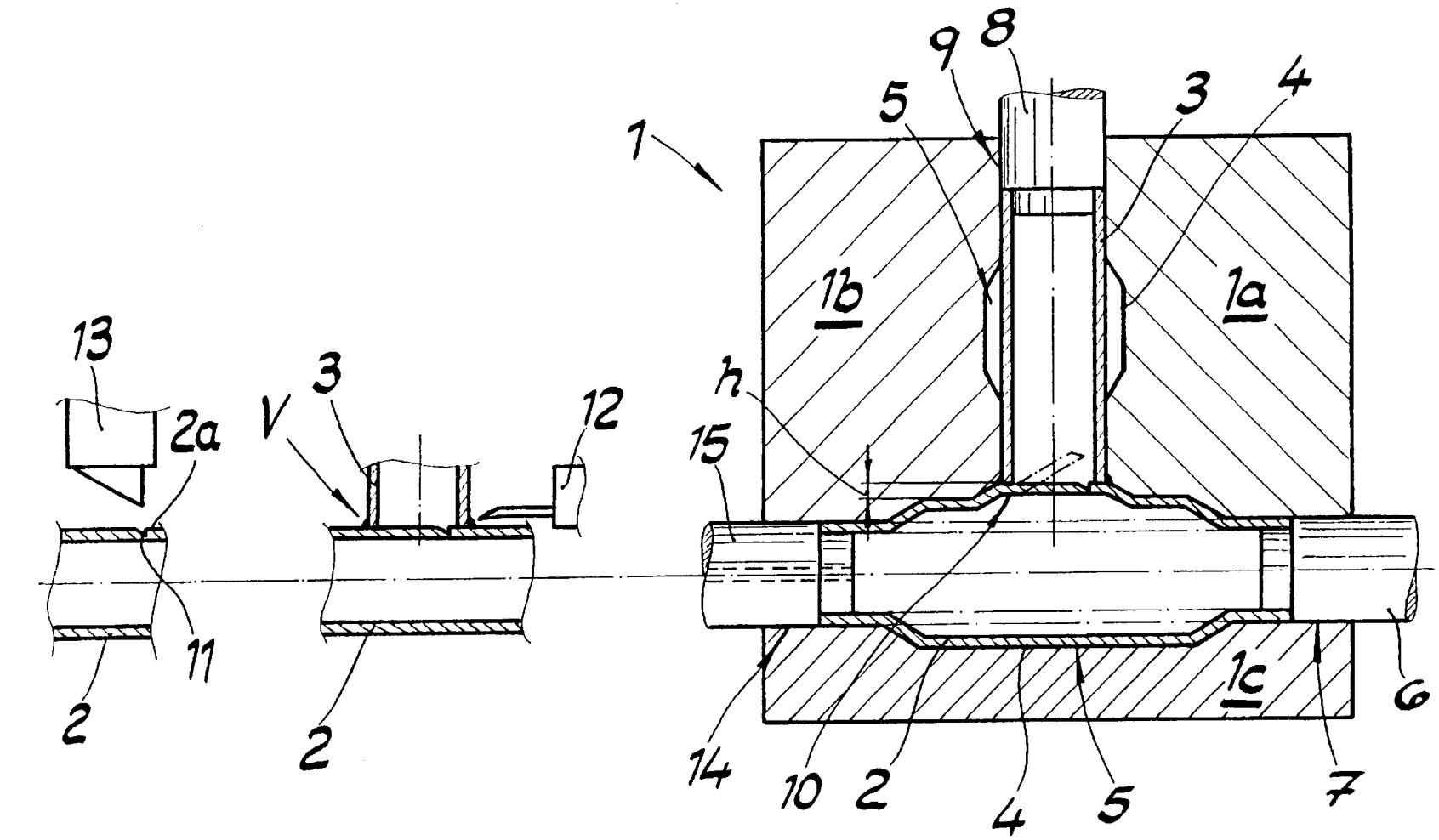
FIGS. 4*a* through 4*c* show an alternative embodiment of the internal high-pressure deforming machine of FIG. 1 during several succeeding process steps.

In the procedure shown in FIGS. 4*a* through 4*c* and 6 before joining the hollow bodies 2 and 3 first the joint region V of the first hollow body 2 with the second hollow body 3 is formed with at least one intended fracture zone 11 in the outer wall 2*a* of the first body 2. To this end the already described drilling and/or stamping device for forming this fracture location is shown in FIG. 4*a*. Also in the alternative embodiment a plurality of intended fracture zones 11 are made as shown clearly in FIG. 5*b*. These intended fracture zones 11 are arranged according to the inner shape of the second hollow body 3 and formed in the outer wall 2*a* of the first hollow body 2.

FIG. 5*b* shows in particular the arrangement corresponding to the inner shape of the second hollow body of the intended fracture zones 11 in the outer wall of the first hollow body 2. The intended fracture zones 11 can be positioned such that they form a sort of hinge so that when the burst pressure PB is exceeded a "lid" effectively swings out to "stand up" in the second hollow body 3. This is shown in dot-dash lines in FIG. 4*c*.

There is also the possibility of using a boring and/or stamping device engaging through the internal high-pressure deforming tool 1 to form the intended fracture zone 11 in the first hollow body 2. This is however not shown. What is illustrated is the separate use of a material-removing device 13 for forming the intended fracture zone 11 (see FIG. 4*a*). The separate welder 12 forming the connecting device 12 can also be integrated into the internal high-pressure deforming tool 1, which is also not shown.

The method according to the invention of the second alternative takes place in the internal high-pressure deforming tool 1 as shown in FIG. 4*a* through 6 as follows. First several intended fracture zones 11 are formed in the outer wall 2*a* of the first hollow body 2 in the joint region between the first hollow body 2 and the second hollow body 3. This is done by the material-removing device 13 primarily by stamping of the intended fracture zones 11 as shown in FIG. 5*b*. The stamping or material removal in the intended fracture zone 11 is done in accordance with the stretch-to-break characteristic of the material of the first hollow body 2 taking into account a predetermined burst pressure PB. This burst pressure PB is shown in FIG. 5*a*.

Then the two hollow bodies 2 and 3 are joined together by welding by means of the connection device or the welder 12 in the joint region V. After joining the two hollow bodies 2 and 3 they are loaded as a single piece into the internal high-pressure deforming tool 1. To this end the internal high-pressure deforming tool 1 is formed of three parts 1*a*, 1*b*, and 1*c* that can be separated from one another. After loading the single part formed by the two hollow bodies 2 and 3, the three movable parts 1*a*, 1*b*, and 1*c* are moved together to form the closed cavity 5 with the inside wall 4.

The devices 6 and 8 as shown in FIG. 6 for loading the hollow bodies 2 and 3 are made as sealing and pushing pistons 6 and 8. Thus as described a hydraulic pressure medium is fed through the internal high-pressure sealing piston 15 to produce the desired internal pressure in the first hollow body 2, without letting the hydraulic medium escape. This is done by the internal high-pressure piston 15 which closes the extra infeed opening 14. The additional infeed openings 7 and 9 are already closed by the pistons 6 and 8. The internal high-pressure deformation now takes place starting with the first hollow body 2. To this end the first hollow body 2 is expanded in the closed cavity 5 of the internal high-pressure deforming tool 1 by means of the hydraulic pressure medium at least in the joint region V of the two hollow bodies 2 and 3 The upward expansion for forming the flange 11 can be determined by the known properties of the material of the hollow-body material of the first hollow body 2 with respect to the burst pressure PB. Thus the upward movement h of the flange 10 is determined mainly by the characteristics of the material and the burst pressure PB. The radial expansion of the flange 10 longitudinally of the first hollow body 2 is determined mainly by the shape of the inner wall 4 of the cavity 5. This applies of course also to other shapes of the first hollow body 2 which are determined by the inner-wall shape 4 which naturally predetermines the shape of the connected hollow body 3.

After exceeding the burst pressure PB for the intended fracture zone 11 the hydraulic medium flows into the second hollow body 3 which otherwise is not pressurized and in particular has no internal high-pressure piston 15 like the first hollow body 2. The hydraulic medium can flow into the second hollow body 3 without doing any internal high-pressure deformation. It is possible to do no internal high-pressure deformation here of the second hollow body 3. This is not shown. More likely one proceeds in that sealing of the infeed opening 9 by means of the sealing and pushing piston 8 creates in the second hollow body the same pressure as in the first hollow body 2. There is therefore after the partial shaping in the first hollow body 2 and after exceeding of the burst pressure PB for the intended fracture zone 11 a final shaping of the second hollow body 3 and naturally also of the first hollow body 2. This is shown in particular in FIG. 5*a*.

In general with the inventive method in both embodiments or with the help of the illustrated internal high-pressure deforming machine 1 parts of different types can be made. This is shown in FIGS. 7*a*–7*c* which show purely schematically a rear axle (FIG. 7*a*), a motor mount (FIG. 7*b*), and a door frame (FIG. 7*c*). As a result the hollow bodies 2 and 3 form with the production method the illustrated hollow-body assemblies.

Generally, the illustrated internal high-pressure deforming machine provides a method for internal high-pressure deformation of two or more hollow bodies 2 and 3 each having at least one opening, in particular metal tubes or metal hollow profiles, namely for the production of hollow-body assemblies comprised of the hollow bodies 2 and 3 as shown in FIG. 7. To this end first an intended fracture zone 11 is formed in an outer wall of the first body 2 at a joint region V of the first hollow body 2 with the later connected hollow body 3, for example by mechanically weakening the mentioned outer wall 2*a* whereupon subsequently the outer wall 2*a* of the first hollow body 2 is expanded by means of a hydraulic pressure medium by internal high pressure at least in the joint region V of the two hollow bodies and then after the hydraulic medium exceeds the burst pressure PB for the intended fracture region 11 it flows into the second hollow body 3 where it can optionally shape it by internal high-pressure deformation.

What is claimed is:

1. A method of joining first and second hollow bodies each having at least one opening, the method comprising the steps of sequentially:

forming a fracture zone in a joint region of the first body;

juxtaposing the first and second bodies in a closed cavity of an internal high-pressure shaping tool with the second body spaced from the fracture zone of the first body;

internally pressurizing the first body with a hydraulic medium until a burst pressure of the first body at the fracture zone is exceeded and the first body ruptures and is deformed outward at the fracture zone into engagement with the second body;

flowing the hydraulic medium through the ruptured fracture zone into the second body; and joining the first body to the second body.

2. The joining method defined in claim 1, wherein the fracture zone is a blind bore, stamping, recess, spark-erosion bore, or metal-etched bore.

3. The joining method defined in claim 1 wherein the first body is formed with a plurality of the fracture zones at the joint region.

4. The joining method defined in claim 1 wherein the fracture zone is formed outside the tool.

5. The joining method defined in claim 1 wherein the first body is joined to the second body outside the tool.

6. A method of joining first and second hollow bodies each having at least one opening, the method comprising the steps of sequentially:

forming a fracture zone in a joint region of the first body;

juxtaposing the first and second bodies in a closed cavity of an internal high-pressure shaping tool with the second body spaced from the fracture zone of the first body;

internally pressurizing the first body with a hydraulic medium until a burst pressure of the first body at the fracture zone is exceeded and the first body ruptures and is deformed outward at the fracture zone into engagement with the second body; and flowing the hydraulic medium through the ruptured fracture zone into the second body and thereby joining the first body to the second body.

7. The joining method defined in claim 6, wherein the fracture zone is a blind bore, stamping, recess, spark-erosion bore, or metal-etched bore.

8. The joining method defined in claim 6 wherein the first body is formed with a plurality of the fracture zones at the joint region.

9. The joining method defined in claim 6 wherein the fracture zone is formed outside the tool.

10. A method of joining first and second hollow bodies each having at least one opening, the method comprising the steps of sequentially:

forming a fracture zone in a joint region of the first body;

fixing the first and second bodies together with the opening of the second body engaged over the fracture zone of the first body;

fitting the fixed-together first and second body to a closed cavity of an internal high-pressure shaping tool;

internally pressurizing the first body with a hydraulic medium until a burst pressure of the first body at the fracture zone is exceeded and the first body ruptures and is deformed outward at the fracture zone into engagement with the second body;

flowing the hydraulic medium through the ruptured fracture zone into the second body; and joining the first body to the second body.

11. The joining method defined in claim 10, wherein the fracture zone is a blind bore, stamping, recess, spark-erosion bore, or metal-etched bore.

12. The joining method defined in claim 10 wherein the first body is formed with a plurality of the fracture zones at the joint region.

13. The joining method defined in claim 10 wherein the fracture zone is formed outside the tool.

14. The joining method defined in claim 10 wherein the first body is joined to the second body outside the tool.

* * * * *